US012644653B2

(12) United States Patent
Yao et al.

(10) Patent No.: US 12,644,653 B2
(45) Date of Patent: Jun. 2, 2026

(54) VAPOR CHAMBER AND DENDRITIC WICK STRUCTURE THEREOF

(71) Applicant: NIDEC CHAUN-CHOUNG TECHNOLOGY CORPORATION, New Taipei City (TW)

(72) Inventors: Han-Chang Yao, New Taipei City (TW); Chia-Ling Chin, New Taipei City (TW); Cheng-Han Jheng, New Taipei City (TW); Yu Han, New Taipei City (TW)

(73) Assignee: NIDEC CHAUN-CHOUNG TECHNOLOGY CORPORATION, New Taipei City (TW)

( * ) Notice: Subject to any disclaimer, the term of this patent is extended or adjusted under 35 U.S.C. 154(b) by 146 days.

(21) Appl. No.: 18/393,541

(22) Filed: Dec. 21, 2023

(65) Prior Publication Data

US 2025/0207865 A1 Jun. 26, 2025

(51) Int. Cl.
*F28D 15/04* (2006.01)

(52) U.S. Cl.
CPC ..... *F28D 15/046* (2013.01)

(58) Field of Classification Search
CPC .... F28D 15/046; F28D 15/04; F28D 15/0233; F28F 2255/18; F28F 2255/00; H05K 7/20; H05K 7/20336
See application file for complete search history.

(56) References Cited

U.S. PATENT DOCUMENTS

2015/0026981 A1* 1/2015 Yang ..... H01L 23/427 29/890.039

FOREIGN PATENT DOCUMENTS

CN 205897914 U * 1/2017

* cited by examiner

*Primary Examiner* — Harry E Arant
(74) *Attorney, Agent, or Firm* — HDLS IPR SERVICES; Chun-Ming Shih

(57) ABSTRACT

A vapor chamber includes a vapor chamber body, multiple dendritic wick structures and a working fluid. The vapor chamber body includes a hollow shell and a capillary wick layer covered on an inner wall of the hollow shell. Each dendritic wick structure has a capillary base and multiple capillary branches. A side of the capillary base is sintered and connected to the capillary wick layer and another side has a convex curved portion. The multiple capillary branches are extended from and formed as one piece with the convex curved portion. The working fluid is filled in the hollow shell. Thereby, the multiple capillary branches and the convex curved portion can increase cooling surface area of the dendritic wick structure to make the vapor chamber and the dendritic wick structure have great cooling efficiency.

7 Claims, 15 Drawing Sheets

VAPOR CHAMBER AND DENDRITIC WICK STRUCTURE THEREOF

BACKGROUND

Technical Field

The disclosure relates to a vapor chamber structure and a manufacturing method thereof, particularly to a vapor chamber and a dendritic wick structure thereof.

Related Art

A related-art vapor chamber includes a flat sealed shell, a wick structure formed in the flat sealed shell and a working fluid filled into the flat sealed shell. The flat sealed shell has a heat-absorbing surface and a heat-releasing surface, which are opposite to each other. By the gas-liquid phase change of the working fluid, heat is transferred from the heat-absorbing surface to the heat-releasing surface to achieve a cooling effect.

However, as vapor chambers pursue thinning, cooling surface area of the wick structure inside the flat sealed shell will be insufficient, resulting in large evaporation superheat of the working fluid, thereby greatly reducing the heat exchange effect inside the vapor chamber, and making thinned vapor chambers have problems such as poor cooling efficiency.

In view of this, the inventors have devoted themselves to the above-mentioned prior art, researched intensively and cooperated with the application of science to try to solve the above-mentioned problems. Finally, the invention which is reasonable and effective to overcome the above drawbacks is provided.

SUMMARY

The disclosure provides a vapor chamber and a dendritic wick structure thereof, which has multiple capillary branches and convex curved portions for increasing cooling surface area of the dendritic wick structure to make the vapor chamber and the dendritic wick structure have great cooling efficiency.

In an embodiment of the disclosure, the disclosure provides a vapor chamber, which includes a vapor chamber body, multiple dendritic wick structures and a working fluid. The vapor chamber body includes a hollow shell and a capillary wick layer covered on an inner wall of the hollow shell. Each dendritic wick structure has a capillary base and multiple capillary branches. A side of the capillary base is sintered and connected to the capillary wick layer and another side has a convex curved portion. The multiple capillary branches are extended from and formed as one piece with the convex curved portion. The working fluid is filled in the hollow shell.

In an embodiment of the disclosure, the disclosure provides a dendritic wick structure, which includes a capillary base and multiple capillary branches. The capillary base has a convex curved portion. The multiple capillary branches are extended from and formed as one piece with the convex curved portion.

Accordingly, the multiple capillary branches and the convex curved portion of the dendritic wick structure can increase cooling surface area of the dendritic wick structure. The multiple dendritic wick structures are sintered on the capillary wick layer of the vapor chamber to increase cooling surface area of the capillary wick layer to let the evaporation superheat of the working fluid small, so that the working fluid can rapidly perform the phase change to effectively improve the heat exchange effect of the vapor chamber and the dendritic wick structure to make the vapor chamber and the dendritic wick structure have great cooling efficiency.

DETAILED DESCRIPTION

Figure 1:
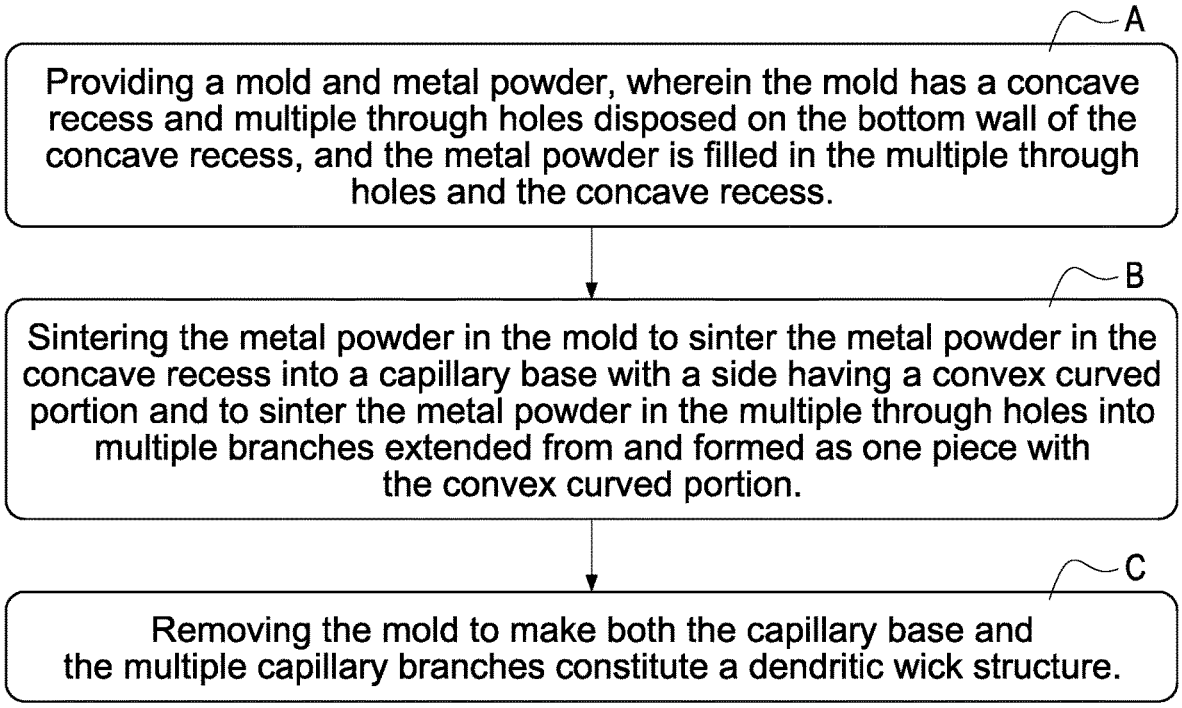
FIG. 1 is a step flowchart of the manufacturing method of the dendritic wick structure of the disclosure.
Figure 2:
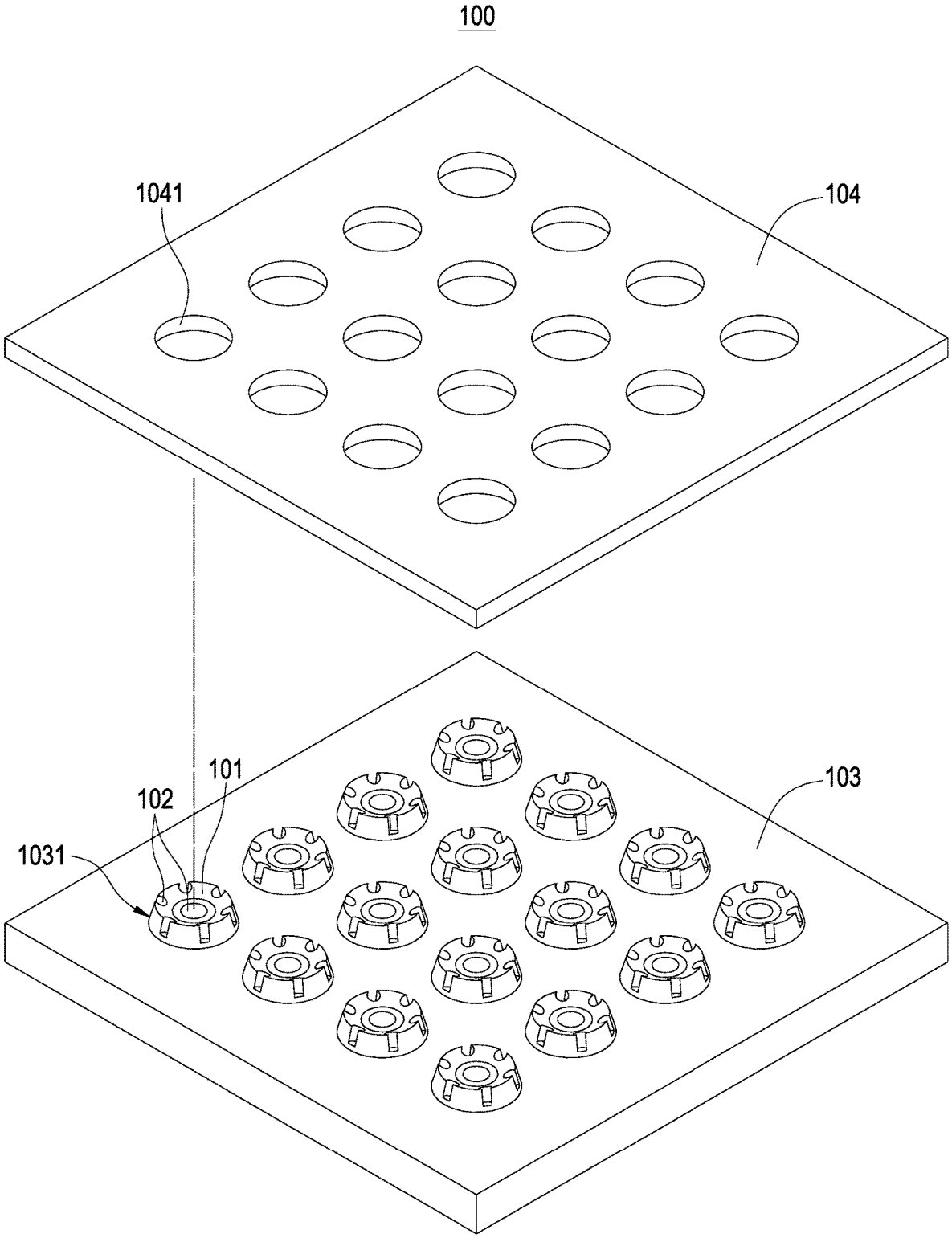
FIG. 2 is an exploded view of the mold of the disclosure.
Figure 3:
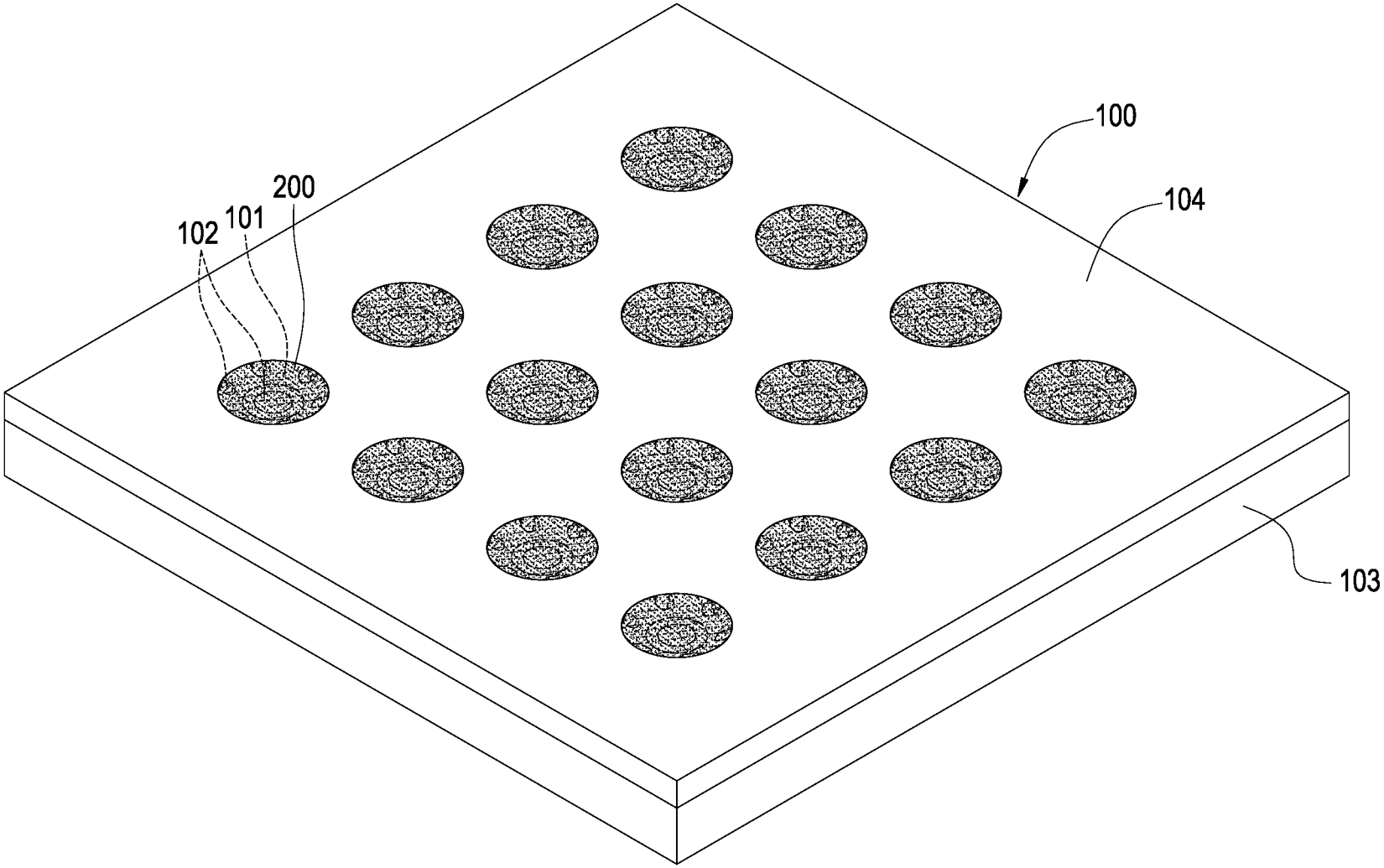
FIG. 3 is a schematic view of the mold filled with metal powder of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-8. The disclosure provides a vapor chamber and a dendritic wick structure thereof. The vapor chamber 10 includes a vapor chamber body 1 and multiple dendritic wick structures 2. The dendritic wick structure 2 includes a capillary base 21 and multiple capillary branches 22.

As shown in FIG. 1, which is a step flowchart of the manufacturing method of the dendritic wick structure 2 of the disclosure. Step 1, as shown in both step A in FIG. 1 and FIGS. 2-3, a mold 100 and metal powder 200 are provided.

The mold 100 has a concave recess 101 and multiple through holes 102 formed at the bottom wall of the concave recess 101. The metal powder 200 is filled in the multiple through holes 102 and the concave recess 101.

The mold 100 includes a lower mold 103 and an upper mold 104, which are superposed. The lower mold 103 is extended with a dish body 1031. The concave recess 101 and the multiple through holes 102 are recessed from the top of the dish body 1031. The upper mold 104 is disposed with an opening 1041 for covering the dish body 1031. An inner periphery of the opening 1041 abuts against an outer periphery of the dish body 1031. The concave recess 101 is a circular concave recess. The multiple through holes 102 are respectively recessed from the bottom wall of the concave recess 101 in a radial arrangement. The dish body 1031 is a conic circular dish having an outer peripheral with a contour tapering toward a direction which is away from the lower mold 103. The opening 1041 is a conic circular opening having an inner peripheral with a contour tapering toward a direction which is away from the lower mold 103.

As a result, the opening 1041 allows the metal powder 200 to be easily filled into the mold 100 therethrough and also allows the metal powder 200 to be pressed through the opening 1041 to let the metal powder 200 smoothly filled into each through hole 102. Also, the dish body 1031 is a conic circular dish and the opening 1041 is a conic circular opening, so that it is easy to stack the lower mold 103 on or separated from the upper mold 104.

Figure 4:
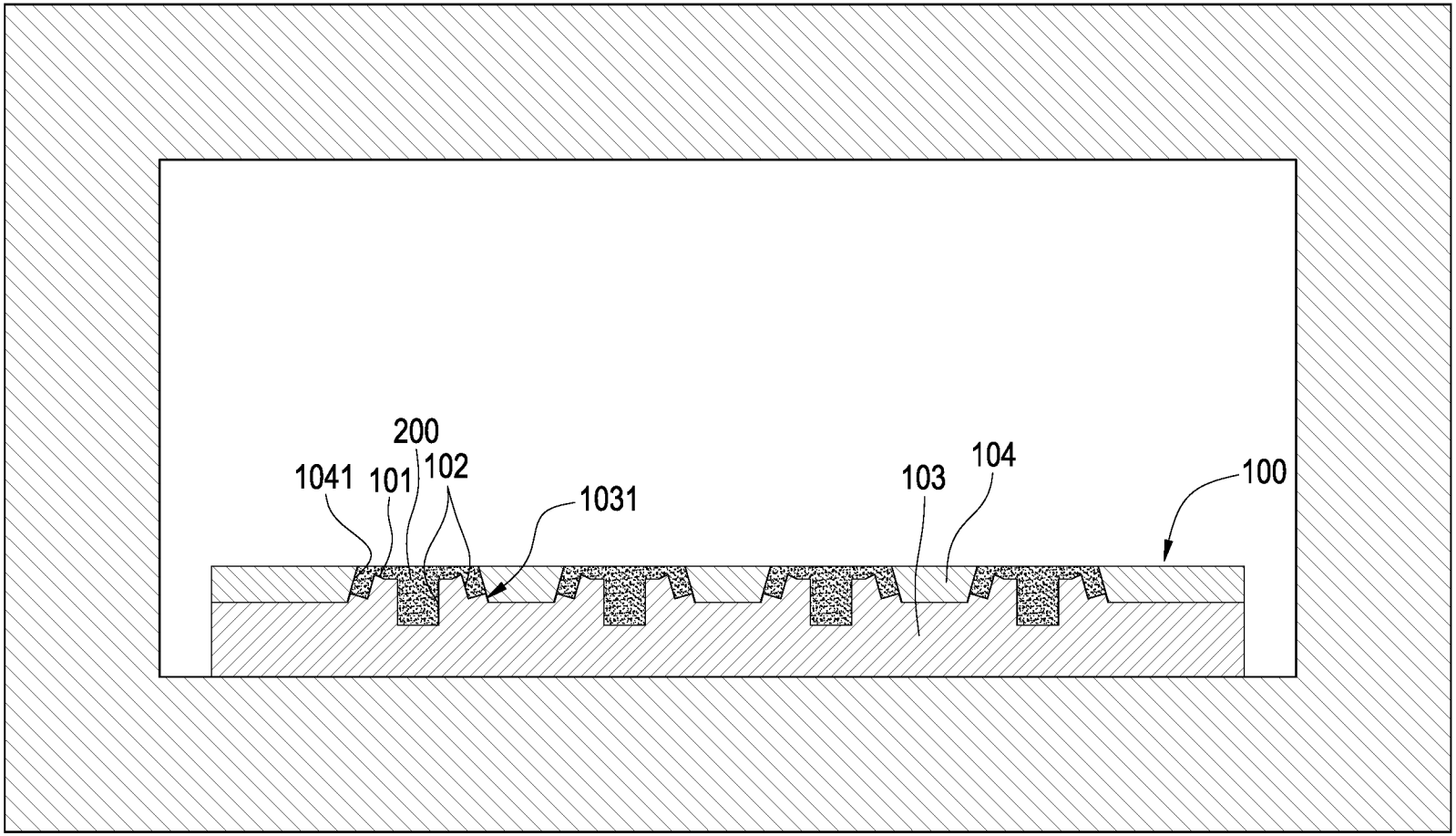
FIG. 4 is a schematic view of the sintering process of the mold and the metal powder of the disclosure.

Step 2, as shown in both step B in FIG. 1 and FIG. 4, the mold 100 and the metal powder 200 are sintered, so that the metal powder 200 in the concave recess 101 are sintered into a capillary base 21 having a convex curved portion 211 at a side thereof, and the metal powder 200 in the multiple through holes 102 are sintered into multiple branches 22 extended from and formed as one piece with the convex curved portion 211.

Figure 5:
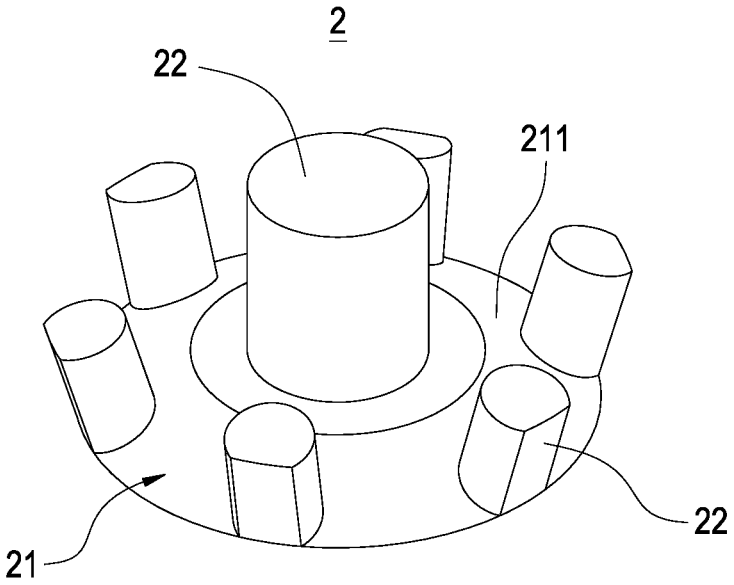
FIG. 5 is a perspective schematic view of the dendritic wick structure of the disclosure.

Step 3, as shown in both step C in FIG. 1 and FIG. 5, the mold 100 is removed, and both the capillary base 21 and the multiple capillary branches 22 constitute a dendritic wick structure 2.

Figure 6:
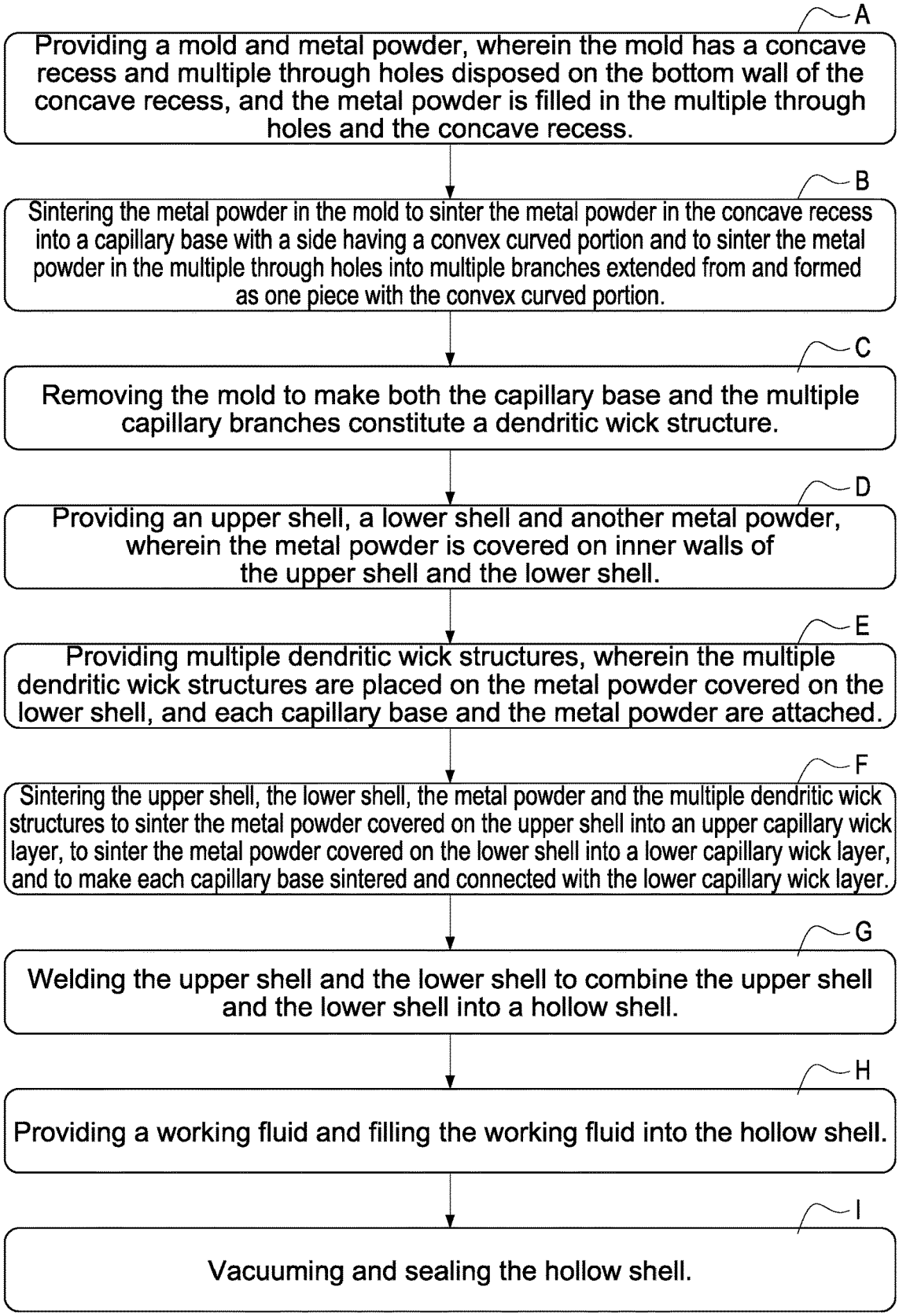
FIG. 6 is a step flowchart of the manufacturing method of the vapor chamber of the disclosure.

As shown in FIG. 6, which is a step flowchart of the manufacturing method of the vapor chamber 10 of the disclosure. Steps 1-3 have been shown in FIGS. 1-5. In step 4 referring to step D as shown in FIG. 6 and also referring to FIG. 7, an upper shell 111, a lower shell 112 and another metal powder (not shown in the figures) are provided, and the metal powder is covered on inner walls of the upper shell 111 and the lower shell 112.

Figure 7:
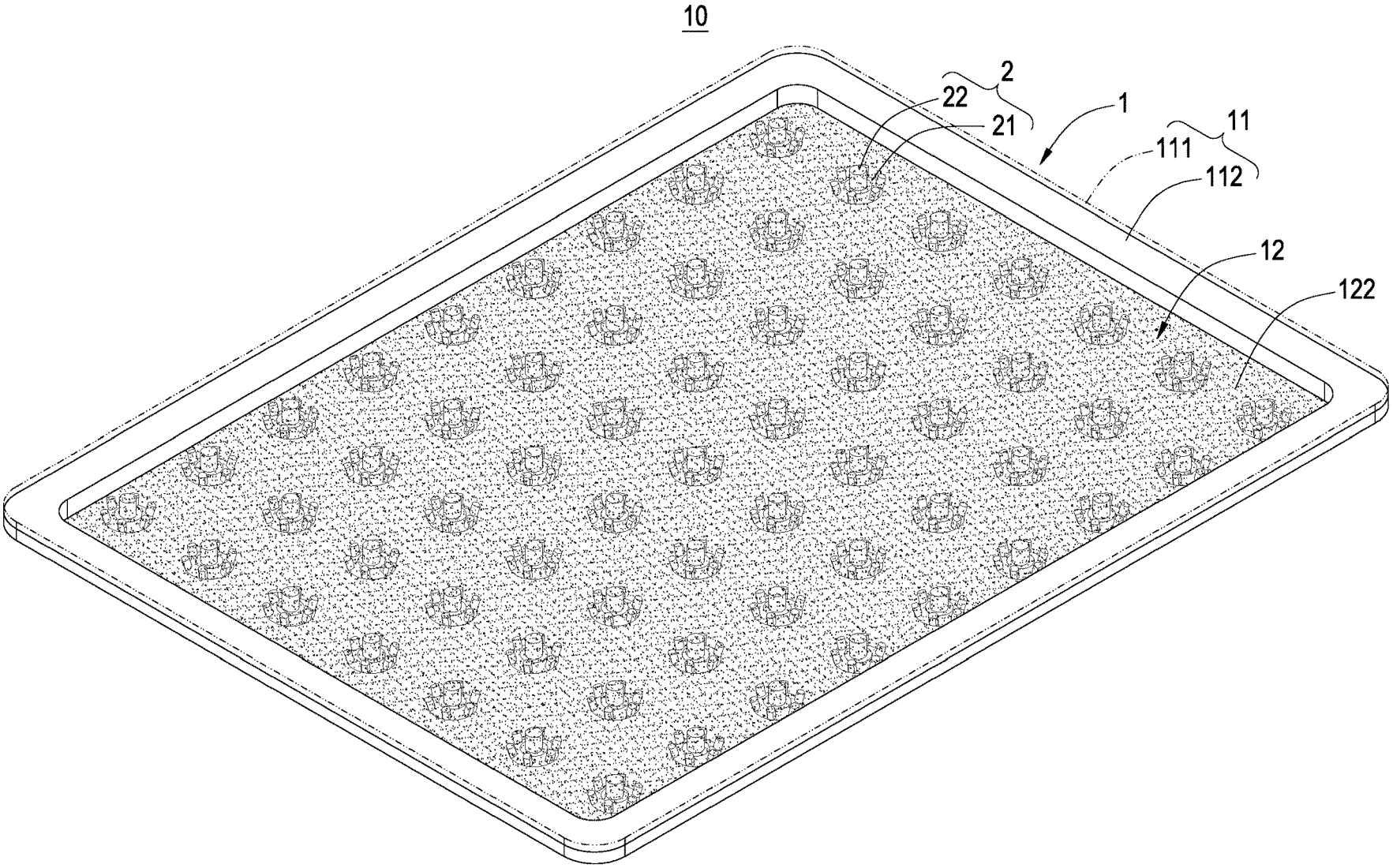
FIG. 7 is a perspective schematic view of the vapor chamber of the disclosure.

In step 5 referring to step E as shown in FIG. 6 and also referring to FIG. 7, multiple dendritic wick structures 2 are provided, the multiple dendritic wick structures 2 are placed on the metal powder covered on the lower shell 112, and each capillary base 21 and the metal powder are attached.

Figure 8:
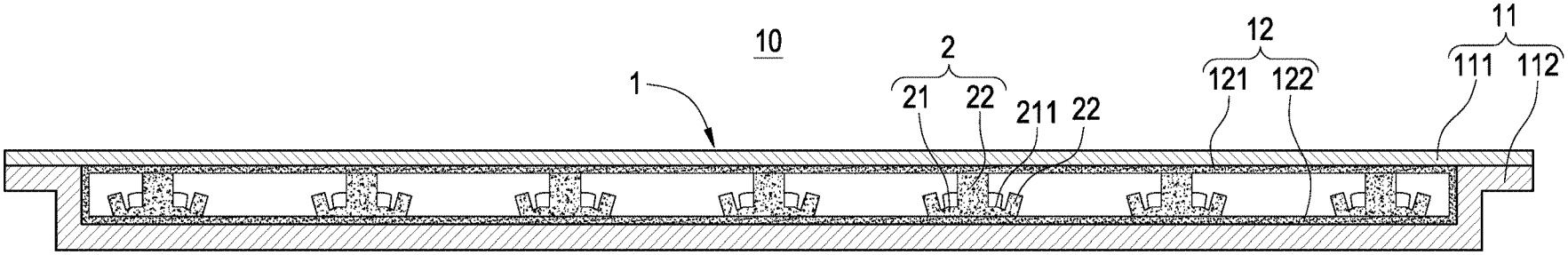
FIG. 8 is a cross-sectional schematic view of the vapor chamber of the disclosure.

In step 6 referring to step F as shown in FIG. 6 and also referring to FIGS. 7-8, the upper shell 111, the lower shell 112, the metal powder 200 and the multiple dendritic wick structures 2 are placed in a heating oven (not shown in the figures) to sinter the upper shell 111, the lower shell 112, the metal powder 200 and the multiple dendritic wick structures 2 to sinter the metal powder covered on the upper shell 111 into an upper capillary wick layer 121, to sinter the metal powder covered on the lower shell 112 into a lower capillary wick layer 122, and to make each capillary base 21 sintered and connected with the lower capillary wick layer 122.

Step 7 referring to step G as shown in FIG. 6 and also referring to FIGS. 7-8, the upper shell 111 and the lower shell 112 are welded to weld outer peripheries of the upper shell 111 and the lower shell 112 to combine into a hollow shell 11 with a degassing aperture (not shown in the figures).

Step 8 referring to step H as shown in FIG. 6 and also referring to FIGS. 7-8, a working fluid (not shown in the figures) is provided, and the working fluid (not shown in the figures) is filled into the hollow shell 11 through the degassing aperture (not shown in the figures).

Step 9 referring to step I as shown in FIG. 6 and also referring to FIGS. 7-8, the hollow shell 11 is vacuumed and sealed, i.e., the inside of the hollow shell 11 is vacuumed through the degassing aperture (not shown in the figures), and then the degassing aperture (not shown in the figures) is weld to be sealed to let the inside of the hollow shell 11 become a closed space to make the upper shell 111, the lower shell 112, the metal powder 200, the multiple dendritic wick structures 2 and the working fluid (not shown in the figures) jointly constitute a vapor chamber 10.

As shown in FIGS. 7-8, the vapor chamber body 1 includes a hollow shell 11 and a capillary wick layer 12 covered on an inner wall of the hollow shell 11. The hollow shell 11 includes an upper shell 111 and a lower shell 112, which are combined vertically. The capillary wick layer 12 is divided into an upper capillary wick layer 121 covered on an inner wall of the upper shell 111 and a lower capillary wick layer 122 covered on an inner wall of the lower shell 112.

As shown in FIGS. 5 and 7-8, each dendritic wick structure 2 has a capillary base 21 and multiple capillary branches 22. A side of the capillary base 21, which is away from the multiple capillary branches 22, is sintered and connected to the capillary wick layer 12, and another side of the capillary base 21 has a convex curved portion 211. The multiple capillary branches 22 are extended from and as one piece with formed the convex curved portion 211.

Furthermore, one of the capillary branches 22 is extended toward the upper capillary wick layer 121 and can be stopped by the upper capillary wick layer 121, i.e., one of the capillary branches 22 is extended upward and its diameter is greater than a diameter of each of the rest of the capillary branches 22, but not limited to this.

In addition, the capillary branch 22 of the embodiment is, but not limited to, a cylinder. The capillary branch 22 can be of any geometric shape. Each convex curved portion 211 is a circular curved surface. The multiple capillary branches 22 are radially arranged, and extended from and formed as one piece with the circular curved surface.

As shown in FIGS. 5 and 7-8, the using status of the vapor chamber 10 and the dendritic wick structure 2 of the disclosure uses the multiple capillary branches 22 and the convex curved portion 211 of the dendritic wick structure 2 to increase cooling surface area of the dendritic wick structure 2. The multiple dendritic wick structures 2 are sintered on the capillary wick layer 12 of the vapor chamber 10 to increase cooling surface area of the capillary wick layer 12 to let the evaporation superheat of the working fluid (not shown in the figures) small, so that the working fluid (not shown in the figures) can rapidly perform the phase change to effectively improve the heat exchange effect of the vapor chamber 10 and the dendritic wick structure 2 to make the vapor chamber 10 and the dendritic wick structure 2 have great cooling efficiency.

In addition, the multiple dendritic wick structures can further serve as multiple support rods supported between the upper shell 111 and the lower shell 112 to prevent the upper shell 111 and the lower shell 112 from being deformed by pressure to enhance the structural strength of the vapor chamber 10.

One of the capillary branches 22 is extended upward and its diameter is greater than a diameter of each of the rest of the capillary branches 22 to let the upward extended capillary branch 22 serves as a main support rod so as to further enhance the ability of the dendritic wick structure 2 supporting the vapor chamber 10.

Please refer to FIGS. 9-17, which show the vapor chamber, the dendritic wick structure, a manufacturing method of the dendritic wick structure and a manufacturing method of the vapor chamber of another embodiment of the disclosure. The embodiment of FIGS. 9-17 is roughly the same as the embodiment of FIGS. 1-8. The embodiment of FIGS. 9-17 differs from the embodiment of FIGS. 1-8 by partial structure of the dendritic wick structure 2.

Figure 9:
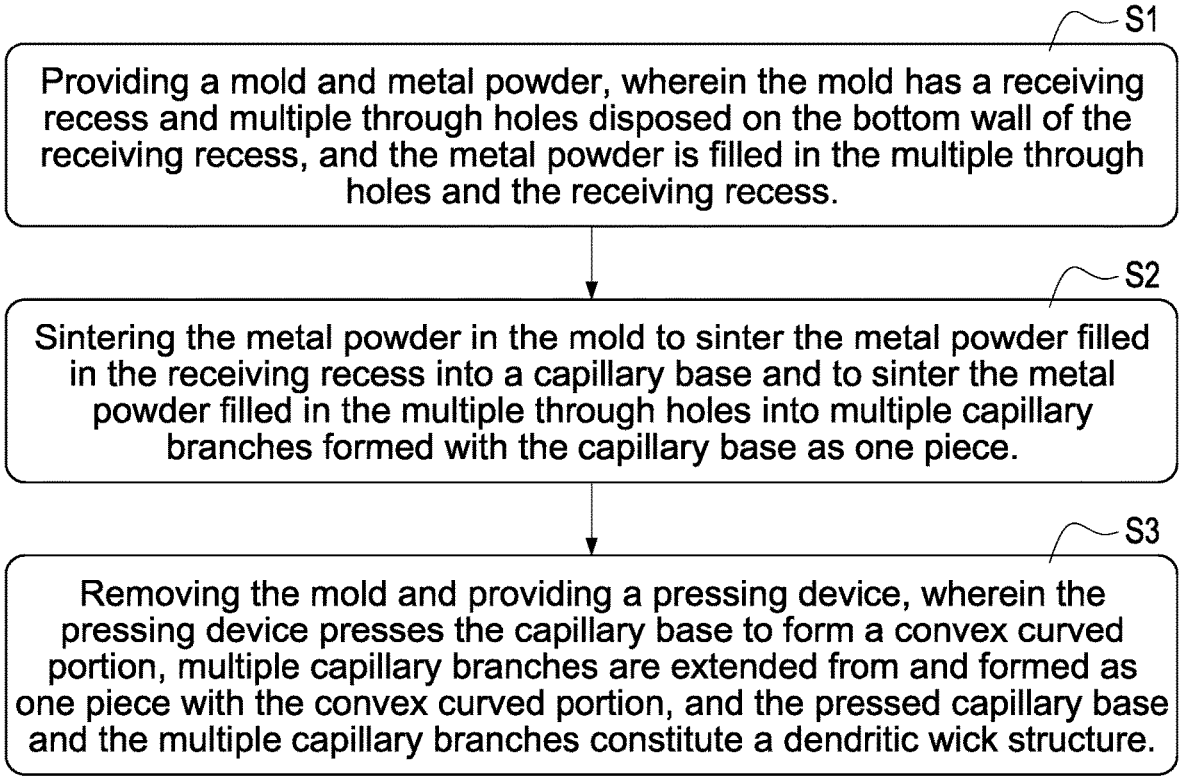
FIG. 9 is a step flowchart of the manufacturing method of another embodiment of the dendritic wick structure of the disclosure.
Figure 10:
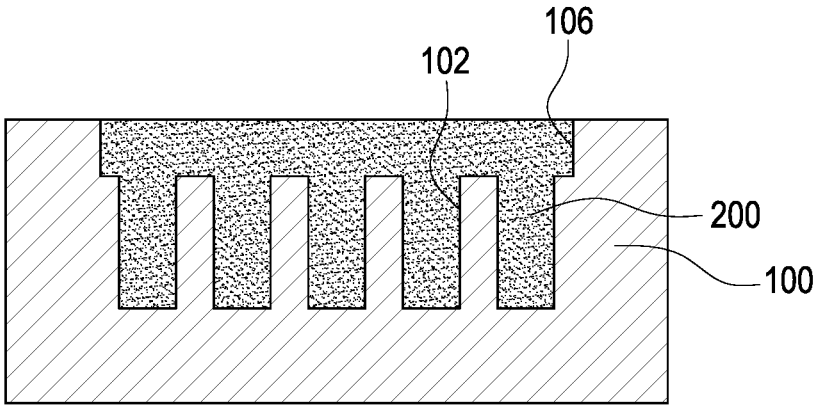
FIG. 10 is a schematic view of the mold filled with metal powder of another embodiment of the disclosure.

As shown in FIG. 9, which shows steps of the manufacturing method of the dendritic wick structure 2. Step 1, as shown in both step S1 in FIG. 9 and FIG. 10, a mold 100 and metal powder 200 are provided. The mold 100 has a receiving recess 106 and multiple through holes 102 formed at the bottom wall of the receiving recess 106. The metal powder 200 is filled in the multiple through holes 102 and the receiving recess 106. The receiving recess 106 is a circular recess.

Figure 11:
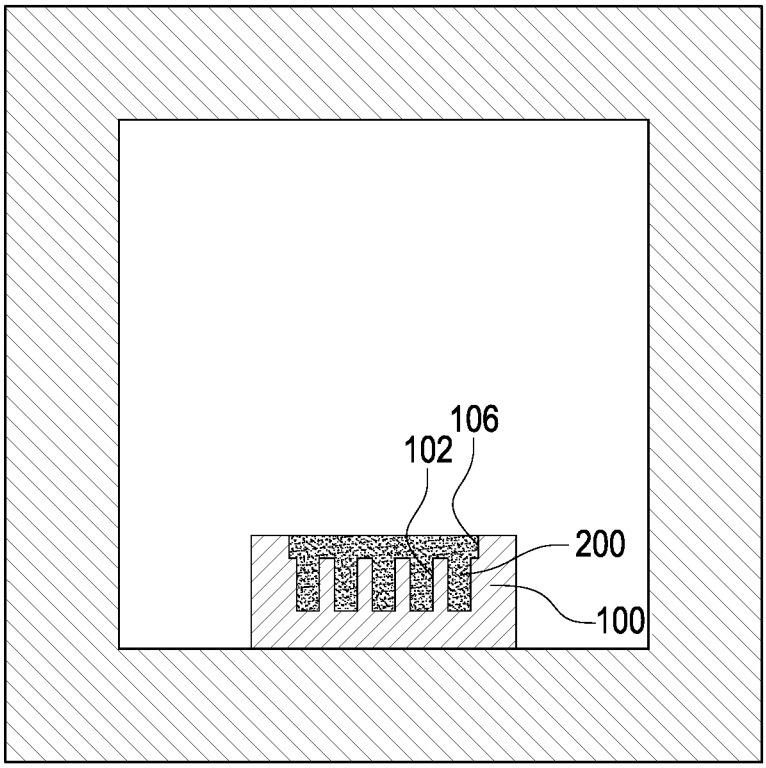
FIG. 11 is a schematic view of the sintering process of the mold and the metal powder of another embodiment of the disclosure.
Figure 12:
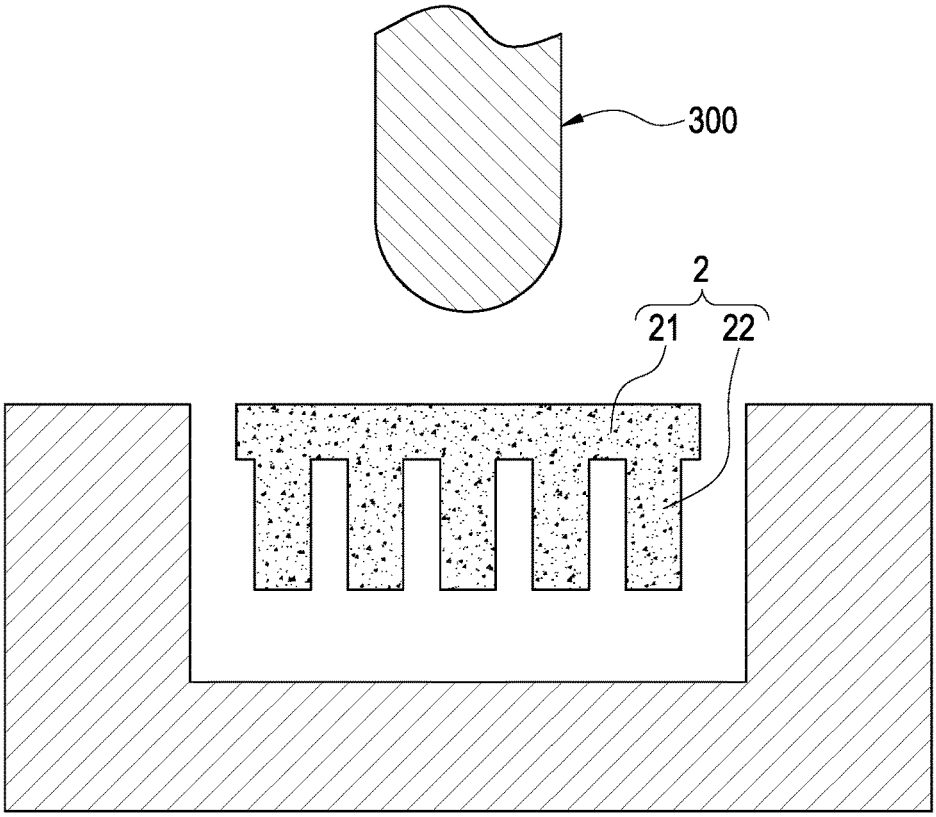
FIG. 12 is a schematic view of the disclosure, which shows the pressing device is pressing the capillary base to form a convex curved portion.
Figure 13:
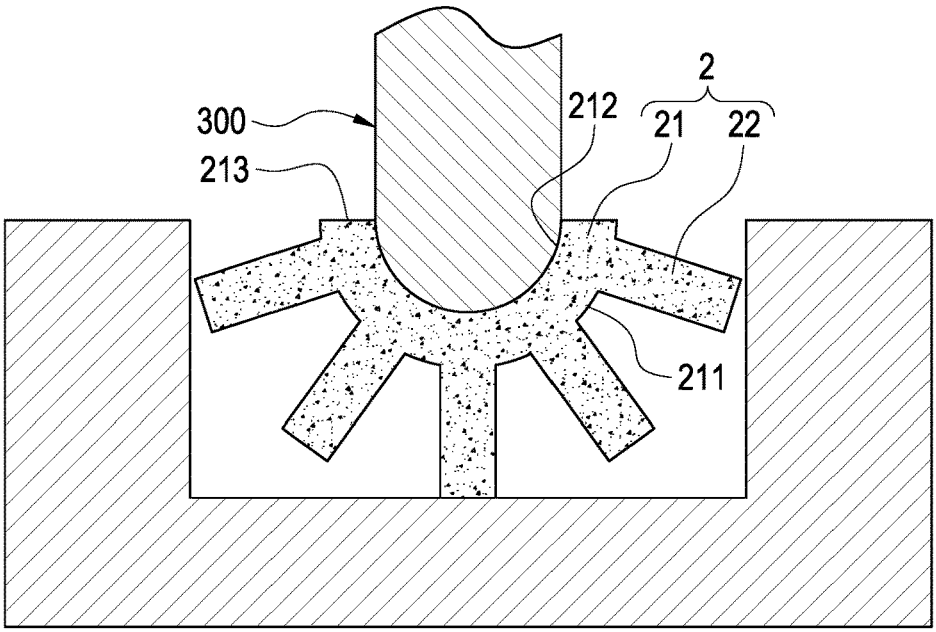
FIG. 13 is a schematic view of the disclosure, which shows the pressing device has pressed the capillary base to form a convex curved portion.

Step 2, as shown in both step S2 in FIG. 9 and FIG. 11, the mold 100 and the metal powder 200 are placed in a heating oven (not shown in the figures) to sinter the mold 100 and the metal powder 200 to sinter the metal powder 200 filled in the receiving recess 106 into a capillary base 21 and to sinter the metal powder 200 filled in the multiple through holes 102 into multiple capillary branches 22 formed as one piece with the capillary base 21.

Step 3, as shown in both step S3 in FIG. 9 and FIGS. 12-14, the mold 100 is removed and a pressing device 300 is provided. The pressing device 300 presses the capillary base 21 to form a convex curved portion 211. Multiple capillary branches 22 are extended from and formed as one piece with the convex curved portion 211. The pressed capillary base 21 and the multiple capillary branches 22 constitute a dendritic wick structure 2.

The pressing device 300 presses a side of the capillary base 21, which is away from the multiple capillary branches 22, to form a concave curved portion 212, and another side of the capillary base 21 is formed with a convex curved portion 211 corresponding to the concave curved portion 211.

Figure 14:
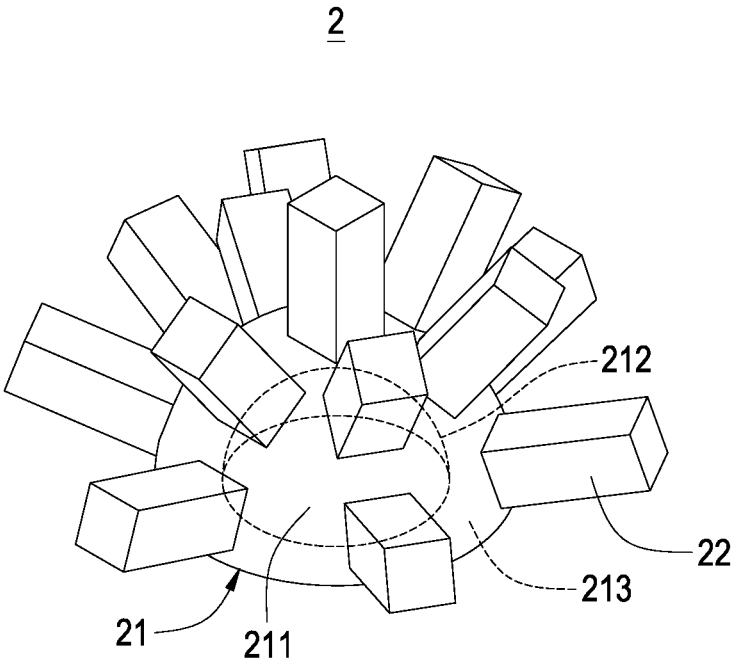
FIG. 14 is a perspective schematic view of another embodiment of the dendritic wick structure of the disclosure.
Figure 15:
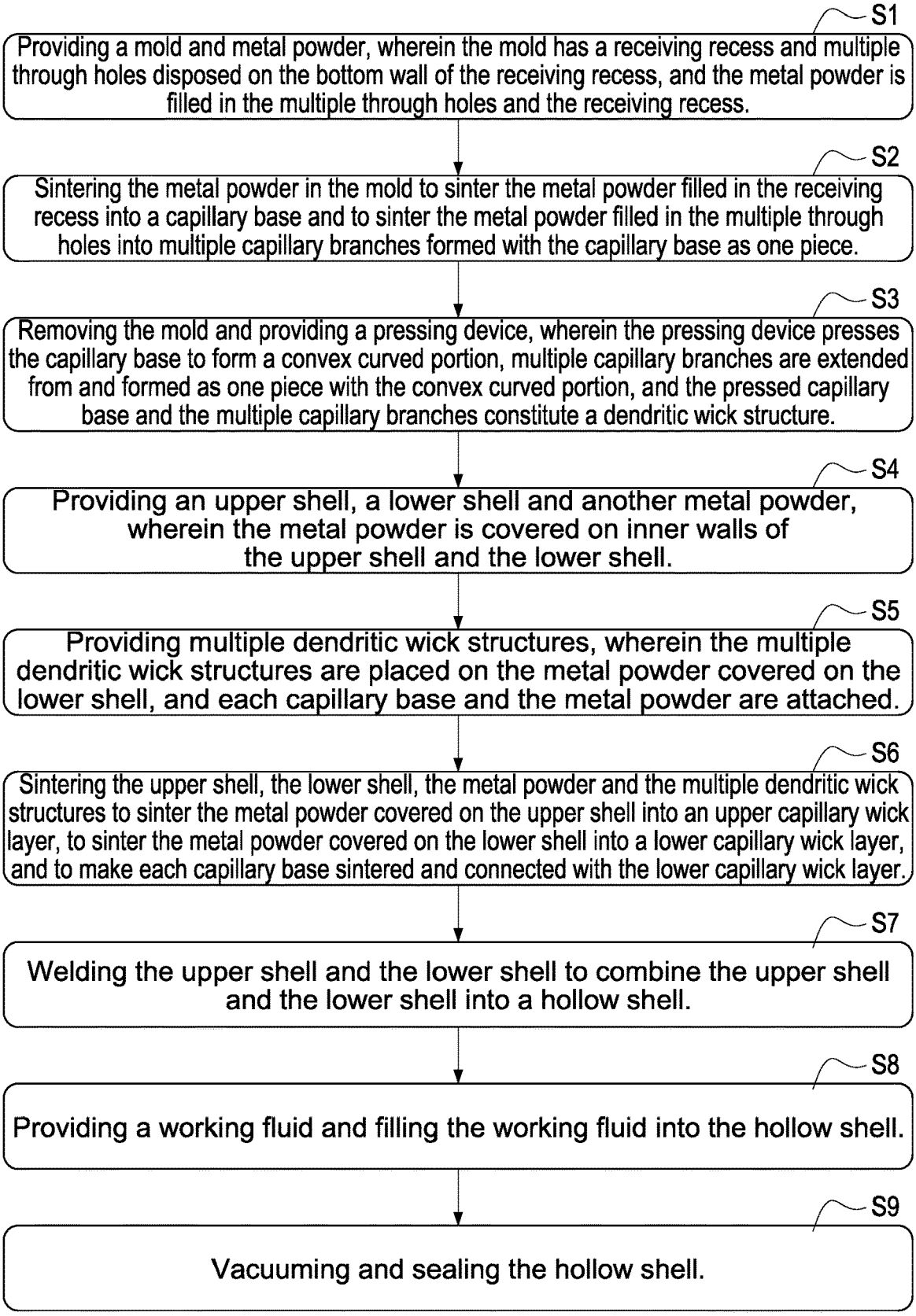
FIG. 15 is a step flowchart of the manufacturing method of another embodiment of the vapor chamber of the disclosure.

As shown in FIG. 15, which shows steps of the manufacturing method of the vapor chamber 10 of the disclosure. Steps 1-3 are as the aforementioned description and shown in FIGS. 9-14. Step 4, as shown in both step S4 in FIG. 15 and FIG. 16, an upper shell 111, a lower shell 112 and another metal powder (not shown in the figures) are provided, and the metal powder is covered on inner walls of the upper shell 111 and the lower shell 112.

Figure 16:
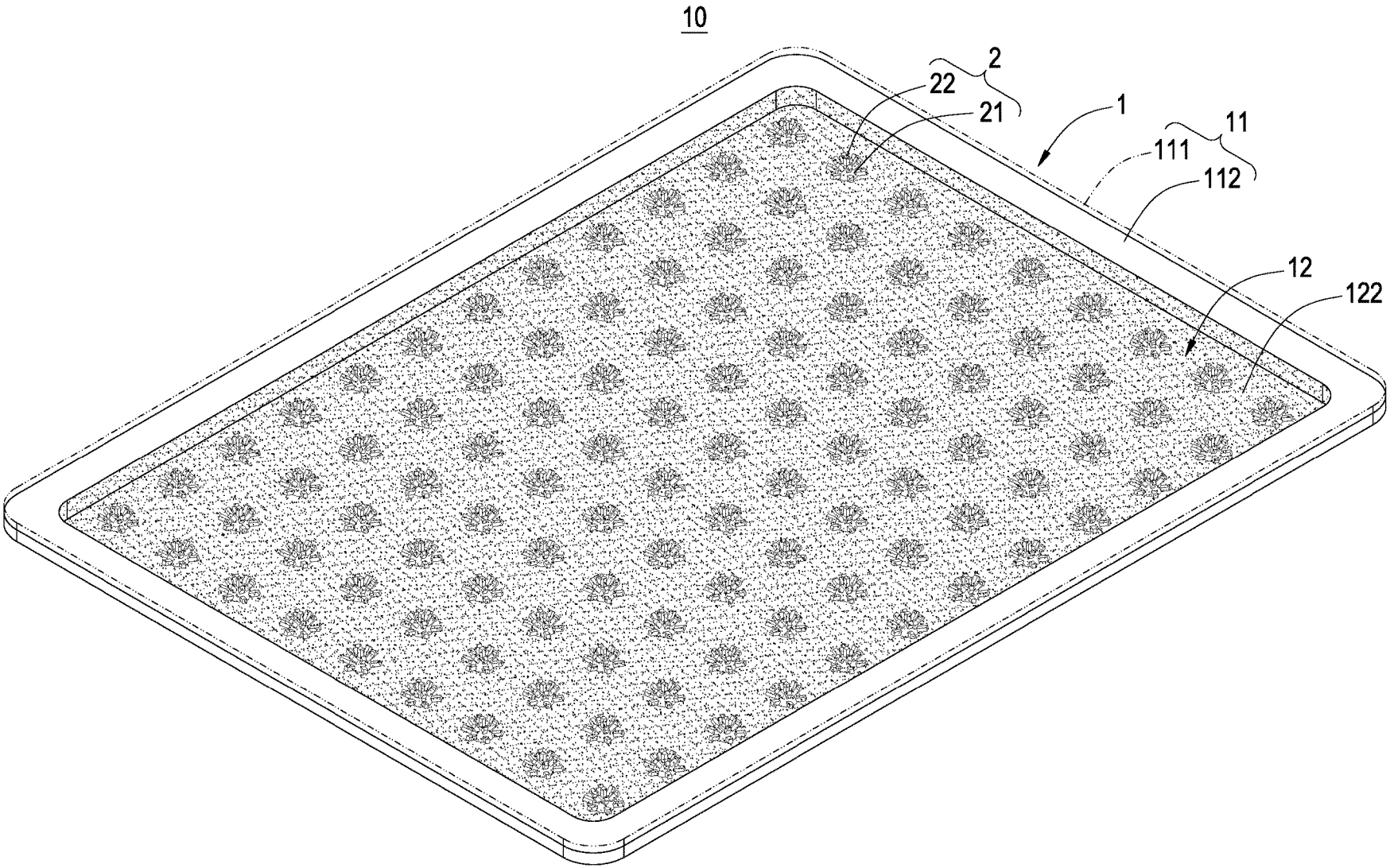
FIG. 16 is a perspective schematic view of another embodiment of the vapor chamber of the disclosure.

Step 5, as shown in both step S5 in FIG. 15 and FIG. 16, multiple dendritic wick structures 2 are provided, the multiple dendritic wick structures 2 are placed on the metal powder covered on the lower shell 112, and each capillary base 21 and the metal powder are attached.

Figure 17:
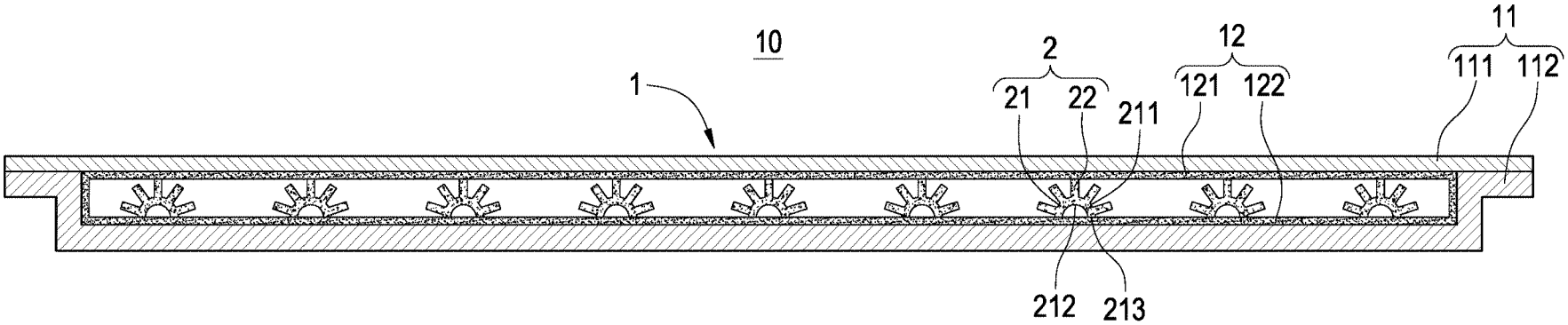
FIG. 17 is a cross-sectional schematic view of another embodiment of the vapor chamber of the disclosure.

Step 6, as shown in both step S6 in FIG. 15 and FIGS. 16-17, the upper shell 111, the lower shell 112, the metal powder 200 and the multiple dendritic wick structures 2 are placed in a heating oven (not shown in the figures) to sinter the upper shell 111, the lower shell 112, the metal powder 200 and the multiple dendritic wick structures 2 to sinter the metal powder covered on the upper shell 111 into an upper capillary wick layer 121, to sinter the metal powder covered on the lower shell 112 into a lower capillary wick layer 122, and to make each capillary base 21 sintered and connected with the lower capillary wick layer 122.

A side of each capillary base 21, which is sintered and connected to the capillary wick layer 12, is disposed with a concave curved portion 212 and has an annular segment 213 formed on an outer periphery of the concave curved portion 212. Each annular segment 213 is sintered and connected to the lower capillary wick layer 122. That is, the concave curved portion 212 is formed between the capillary base 21 and the lower capillary wick layer 122. The capillary base 21 and the lower capillary wick layer 122 are connected by the annular segment 213 to make the concave curved portion 212 wrapped to be a closed space.

Step 7, as shown in both step S7 in FIG. 15 and FIGS. 16-17, the upper shell 111 and the lower shell 112 are welded to make outer peripheries of the upper shell 111 and the lower shell 112 are combined into a hollow shell by welding. The hollow shell 11 is disposed with a degassing aperture (not shown in the figures).

Step 8, as shown in both step S8 in FIG. 15 and FIGS. 16-17, a working fluid (not shown in the figures) is provided, and the working fluid (not shown in the figures) is filled into the hollow shell 11 through the degassing aperture (not shown in the figures).

Step 9, as shown in both step S9 in FIG. 15 and FIGS. 16-17, the hollow shell 11 is vacuumed and sealed, i.e., the inside of the hollow shell 11 is vacuumed through the degassing aperture (not shown in the figures), and then the degassing aperture (not shown in the figures) is weld to be sealed to let the inside of the hollow shell 11 become a closed space to make the upper shell 111, the lower shell 112, the upper capillary wick layer 121, the lower capillary wick layer 122, the multiple dendritic wick structures 2 and the working fluid (not shown in the figures) jointly constitute a vapor chamber 10.

As shown in FIGS. 16-17, the vapor chamber body 1 includes a hollow shell 11 and a capillary wick layer 12 covered on an inner wall of the hollow shell 11. The hollow shell 11 includes an upper shell 111 and a lower shell 112, which are combined vertically. The capillary wick layer 12 is divided into an upper capillary wick layer 121 covered on an inner wall of the upper shell 111 and a lower capillary wick layer 122 covered on an inner wall of the lower shell 112.

As shown in FIGS. 14 and 16-17, each dendritic wick structure 2 has a capillary base 21 and multiple capillary branches 22. A side of the capillary base 21, which is away from the multiple capillary branches 22, is sintered and connected to the capillary wick layer 12, and another side of the capillary base 21 has a convex curved portion 211. The multiple capillary branches 22 are extended from and formed as one piece with the convex curved portion 211.

In addition, a side of each capillary base 21, which is connected to the capillary wick layer 12, is disposed with a concave curved portion 212 formed inside the convex curved portion 211 and has an annular segment 213 formed on an outer periphery of the concave curved portion 212. Each annular segment 213 is sintered and connected to the capillary wick layer 12.

In addition, the capillary branch 22 of the embodiment is, but not limited to, a rectangular rod. The capillary branch 22 can be of any geometric shape. Each convex curved portion 211 is a circular curved surface. The multiple capillary branches 22 are radially arranged and extended from and formed as one piece with the circular curved surface. Each concave curved portion 212 is a hemispherical recess. Each annular segment 213 is a circular ring. As a result, the same functions and effects as the embodiment of FIGS. 1-8 can be achieved.

While this disclosure has been described by means of specific embodiments, numerous modifications and variations could be made thereto by those skilled in the art without departing from the scope and spirit of this disclosure set forth in the claims.

What is claimed is:

1. A vapor chamber comprising:

a vapor chamber body, comprising a hollow shell and a capillary wick layer covered on an inner wall of the hollow shell;

multiple dendritic wick structures, each dendritic wick structure comprising a capillary base and multiple capillary branches, a side of the capillary base being sintered and connected to the capillary wick layer and another side comprising a convex curved portion, and the multiple capillary branches being extended from and formed as one piece with the convex curved portion; and a working fluid, filled in the hollow shell;

wherein the side of the capillary base, which is connected to the capillary wick layer, is disposed with a concave curved portion formed inside the convex curved portion and an annular segment formed on an outer periphery of the concave curved portion, the annular segment is sintered and connected to the capillary wick layer, and the capillary base and the lower capillary wick layer are connected by the annular segment to make the concave curved portion wrapped to be a closed space formed between the capillary base and the capillary wick layer.

2. The vapor chamber of claim 1, wherein each convex curved portion is a circular curved surface, and the multiple capillary branches are radially arranged and extended from and formed as one piece with the circular curved surface.

3. The vapor chamber of claim 1, wherein the hollow shell comprises an upper shell and a lower shell, which are combined vertically, the capillary wick layer is divided into an upper capillary wick layer covered on an inner wall of the upper shell and a lower capillary wick layer covered on an inner wall of the lower shell.

4. The vapor chamber of claim 3, wherein the side of the capillary base, which is away from the multiple capillary branches is sintered and connected to the lower capillary wick layer.

5. The vapor chamber of claim 4, wherein one of the capillary branches is extended toward the upper capillary wick layer, and one of the capillary branches can be stopped by the upper capillary wick layer and a diameter thereof is greater than a diameter of each of the rest of the capillary branches.

6. The vapor chamber of claim 4, wherein each annular segment is sintered and connected to the capillary wick layer, and each concave curved portion is a hemispherical recess.

7. The vapor chamber of claim 1, wherein a distance between two capillary branches is increased along a direction away from the convex curved portion.

* * * * *